US006375320B1

(12) United States Patent
Chu et al.

(10) Patent No.: US 6,375,320 B1
(45) Date of Patent: Apr. 23, 2002

(54) INK JET PRINTING METHOD

(75) Inventors: Lixin Chu, Rochester; Tienteh Chen, Penfield, both of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/522,435

(22) Filed: Mar. 9, 2000

(51) Int. Cl.[7] ..... B41J 2/01

(52) U.S. Cl. ..... 347/105; 347/100; 347/101; 428/195

(58) Field of Search ..... 347/101, 105, 347/100; 428/195

(56) References Cited

U.S. PATENT DOCUMENTS 5,576,088 A 11/1996 Ogawa et al.
5,696,182 A * 12/1997 Kashiwazaki et al. ..... 347/100

FOREIGN PATENT DOCUMENTS

EP 0 499 099 A1 8/1992
EP 0813978 A1 * 12/1997 ..... B41M/5/00
EP 0 934 833 A2 8/1999
EP 0934833 A2 * 11/1999 ..... B41M/5/00

* cited by examiner

*Primary Examiner*—John Barlow
*Assistant Examiner*—Manish S. Shah
(74) *Attorney, Agent, or Firm*—Harold E. Cole

(57) ABSTRACT

An ink jet printing method, comprising the steps of:

A) providing an ink jet printer that is responsive to digital data signals;

B) loading the printer with ink-receptive elements comprising a substrate having thereon an image-receiving layer comprising an inorganic filler and coated particles comprising a polymeric hard core-polymeric soft shell latex, the Tg of the polymeric hard core material being greater than about 60° C., the Tg of the polymeric soft shell material being less than about 20° C., and the inorganic filler being present in the image-receiving layer in an amount of from about 50 to about 95% by weight;

C) loading the printer with an ink jet ink composition; and

D) printing on the ink-receptive element using the ink jet ink in response to the digital data signals.

6 Claims, No Drawings

INK JET PRINTING METHOD

CROSS REFERENCE TO RELATED APPLICATIONS

Reference is made to commonly assigned, co-pending U.S. patent application Ser. No. 09/522151 by Chu et al., filed concurrently herewith "Ink Jet Recording Element"; the disclosure of which is hereby incorporated by reference.

FIELD OF THE INVENTION

This invention relates to an ink jet printing method. More particularly, this invention relates to an ink jet printing method employing a recording element containing coated particles.

BACKGROUND OF THE INVENTION

In a typical ink jet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water, an organic material such as a monohydric alcohol, a polyhydric alcohol or mixtures thereof.

An ink jet recording element typically comprises a support having on at least one surface thereof an ink-receiving or image-forming layer, and includes those intended for reflection viewing, which have an opaque support, and those intended for viewing by transmitted light, which have a transparent support.

While a wide variety of different types of image-recording elements for use with ink jet devices have been proposed heretofore, there are many unsolved problems in the art and many deficiencies in the known products which have limited their commercial usefulness.

It is well known that in order to achieve and maintain photographic-quality images on such an image-recording element, an ink jet recording element must:

- Be readily wetted so there is no puddling, i.e., coalescence of adjacent ink dots, which leads to non-uniform density
- Exhibit no image bleeding
- Exhibit the ability to absorb high concentrations of ink and dry quickly to avoid elements blocking together when stacked against subsequent prints or other surfaces
- Exhibit no discontinuities or defects due to interactions between the support and/or layer(s), such as cracking, repellencies, comb lines and the like
- Not allow unabsorbed dyes to aggregate at the free surface causing dye crystallization, which results in bloom or bronzing effects in the imaged areas
- Have an optimized image fastness to avoid fade from contact with water or radiation by daylight, tungsten light, or fluorescent light An ink jet recording element that simultaneously provides an almost instantaneous ink dry time and good image quality is desirable. However, given the wide range of ink compositions and ink volumes that a recording element needs to accommodate, these requirements of ink jet recording media are difficult to achieve simultaneously.

Ink jet recording elements are known that employ porous or non-porous single layer or multilayer coatings that act as suitable image receiving layers on one or both sides of a porous or non-porous support. Recording elements that use non-porous coatings typically have good image quality but exhibit poor ink dry time. Recording elements that use porous coatings typically contain colloidal particulates and have poorer image quality but exhibit superior dry times.

While a wide variety of different types of porous image-recording elements for use with ink jet printing are known, there are many unsolved problems in the art and many deficiencies in the known products which have severely limited their commercial usefulness. The challenge of making a porous image recording layer is to achieve a high gloss level without cracking, high color density, and a fast drying time.

U.S. Pat. No. 5,576,088 relates to an ink jet recording element wherein a gloss providing layer containing an inorganic filler and a latex is coated on top of an ink receiving layer. However, there is a problem with this element in that the drying time is slow and there is a tendency for the layer to exhibit cracks.

It is an object of this invention to provide an ink jet printing method using an ink jet recording element that has a fast ink dry time. It is another object of this invention to provide an ink jet printing method using an ink jet recording element that has good image quality.

SUMMARY OF THE INVENTION

These and other objects are achieved in accordance with the invention which comprises an ink jet printing method, comprising the steps of:

A) providing an ink jet printer that is responsive to digital data signals;

B) loading the printer with ink-receptive elements comprising a substrate having thereon an image-receiving layer comprising an inorganic filler and coated particles comprising a polymeric hard core-polymeric soft shell latex, the Tg of the polymeric hard core material being greater than about 60° C., the Tg of the polymeric soft shell material being less than about 20° C., and the inorganic filler being present in the image-receiving layer in an amount of from about 50 to about 95% by weight;

C) loading the printer with an ink jet ink composition; and

D) printing on the ink-receptive element using the ink jet ink in response to the digital data signals.

The ink jet recording element obtained by the method of the invention provides a fast ink dry time and good image quality.

DETAILED DESCRIPTION OF THE INVENTION

The substrate used in the invention may be porous such as paper or non-porous such as resin-coated paper; synthetic paper, such as Teslin® or Tyvek®; an impregnated paper such as Duraform®; cellulose acetate or polyester films. The surface of the substrate may be treated in order to improve the adhesion of the image-receiving layer to the support. For example, the surface may be corona discharge treated prior to applying the image-receiving layer to the support. Alternatively, an under-coating or subbing layer, such as a layer formed from a halogenated phenol or a partially hydrolyzed vinyl chloride-vinyl acetate copolymer, can be applied to the surface of the support.

As described above, the image-receiving layer employed in the process of the invention contains an inorganic filler and a polymeric latex. Any inorganic filler may be used in the invention, such as metal oxides or hydroxides. In a preferred embodiment of the invention, the metal oxide is silica, alumina, zirconia or titania. In another preferred embodiment of the invention, the particle size of the filler is from about 5 nm to about 1000 nm.

The coated particles comprising a polymeric hard core-polymeric soft shell latex used in the process of the invention comprises polymeric particles having a core of material having a relatively high Tg which is coated with another polymer having a relatively low Tg. Core-shell latexes used in the invention may be prepared by emulsion polymerization are described in "Emulsion Polymerization and Emulsion Polymers", edited by P. A. Lovell and M. S. El-Aassar, John Wiley and Sons, 1997.

The core material polymer used in the process of the invention has a Tg of at least about 60° C., preferably from about 60° C. to about 150° C. Examples of these polymers include poly(methylmethacrylate), poly(styrene), poly(p-methylstyrene), poly(t-butylacrylamide), poly(styrene-co-methylmethacrylate), poly(styrene-co-t-butylacrylamide), poly(methylmethacrylate-co-t-butylacrylamide), and homopolymers derived from p-cyanophenyl methacrylate, pentachlorophenyl acrylate, methacrylonitrile, isobornyl methacrylate, phenyl methacrylate, acrylonitrile, isobornyl acrylate, p-cyanophenyl acrylate, 2-chloroethyl acrylate, 2-chloroethyl methacrylate, 2-naphthyl acrylate, n-isopropyl acrylamide, 1-fluoromethyl methacrylate, isopropyl methacrylate, and 2-hydroxypropyl methacrylate. In a preferred embodiment of the invention, the core polymer is poly(methylmethacrylate), poly(styrene), poly(p-methylstyrene), poly(t-butylacrylamide) or poly(styrene-co-methylmethacrylate).

The shell material polymer used in the element employed in the process of the invention has a Tg of about 20° C. or lower, preferably from about −50° C. to about 20° C. Examples of these soft shell polymers which may be used in the invention include homo- and copolymers derived from the following monomers: n-butyl acrylate, n-ethylacrylate, 2-ethylhexylacrylate, methoxyethylacrylate, methoxyethoxy-ethylacrylate, ethoxyethylacrylate, ethoxyethoxyethylacrylate, 2-ethylhexyl-methacrylate, n-propylacrylate, hydroxyethylacrylate, etc. and cationic monomers such as a salt of trimethylammoniumethyl acrylate and trimethylammoniumethyl methacrylate, a salt of triethylammoniumethyl acrylate and triethylammonium-ethyl methacrylate, a salt of dimethylbenzylammoniumethyl acrylate and dimethylbenzylammoniumethyl methacrylate, a salt of dimethylbutylammonium-ethyl acrylate and dimethylbutylammoniumethyl methacrylate, a salt of dimethylhexylammoniumethyl acrylate and dimethylhexylammoniumethyl methacrylate, a salt of dimethyloctylammoniumethyl acrylate and dimethyloctyl-ammoniumethyl methacrylate, a salt of dimethyldodeceylammoniumethyl acrylate and dimethyldocecylammoniumethyl methacrylate, a salt of dimethyloctadecyl-ammoniumethyl acrylate and dimethyloctadecylammoniumethyl methacrylate, etc. Salts of these cationic monomers which can be used include chloride, bromide, methylsulfate, triflate, etc.

Examples of these shell material polymers include poly (n-butylacrylate-co-vinylbenzyltrimethylammonium chloride), poly(n-butylacrylate-co-vinylbenzyltrimethylammonium bromide), poly(n-butylacrylate-co-vinylbenzyldimethylbenzylammonium chloride) and poly(n-butylacrylate-co-vinylbenzyldimethyloctadecylammonium chloride). In a preferred embodiment of the invention, the shell polymer can be poly(n-butyl acrylate), poly(2-ethylhexyl acrylate) poly(methoxyethylacrylate), poly(ethoxy-ethylacrylate), poly(n-butylacrylate-co-trimethylammoniumethyl acrylate), poly(n-butylacrylate-co-trimethylammoniumethyl methacrylate) or poly(n-butylacrylate-co-vinylbenzyltrimethylammonium chloride).

Following are examples of coated particles of polymeric soft shell-polymeric hard core materials which can be used in the process of the invention:

| Polymeric Latex | Core Material (wt. %) | Shell Material (wt. %) |
|---|---|---|
| 1 | Polystyrene (50) | Poly n-butylacrylate (50) |
| 2 | Polystyrene (50) | Poly n-ethylhexylacrylate (50) |
| 3 | Polymethylmethacrylate (50) | Poly n-butylacrylate (50) |
| 4 | Polystyrene (40) | Poly n-butylacrylate (60) |
| 5 | Polymethylmethacrylate (40) | Poly n-butylacrylate (60) |
| 6 | Polystyrene (40) | Poly(n-butylacrylate-co-trimethylammonium ethyl methacrylate (40:20) |
| 7 | Polymethylmethacrylate (40) | Poly(n-butylacrylate-co-trimethylammonium ethyl methacrylate (40:20) |
| 8 | Polystyrene (40) | Poly(n-butylacrylate-co-vinylbenzyltrimethyl-ammonium chloride) (40:20) |
| 9 | Polymethylmethacrylate (40) | Poly(n-butylacrylate-co-vinylbenzyltrimethyl-ammonium chloride) (40:20) |
| 10 | Polystyrene (40) | Poly n-ethylhexylacrylate (60) |

An additional binder can also be used in the image-recording layer employed in the process of the invention, e.g., a water soluble polymer such as poly(vinyl alcohol), gelatin, poly(vinyl pyrrolidone), poly(2-ethyl-2-oxazoline), poly(2methyl-2-oxazoline), poly(acrylamide), Chitosan, methylcellulose, ethyl cellulose, hydroxyethyl cellulose, hydroxypropyl cellulose, etc. Other binders can also be used such as low Tg polymer latexes such as poly(styrene-co-butadiene), a polyurethane latex, a polyester latex, poly(n-butyl acrylate), poly(n-butyl methacrylate), poly(2-ethylhexyl acrylate), a copolymer of n-butylacrylate and ethylacrylate, a copolymer of vinylacetate and n-butylacrylate, etc.

Other additives may also be included in the image-recording layer such as pH-modifiers like nitric acid, cross-linkers, rheology modifiers, surfactants, UV-absorbers, biocides, lubricants, dyes, dye-fixing agents or mordants, optical brighteners etc.

The ink jet coating may be applied to one or both substrate surfaces through conventional pre-metered or post-metered coating methods such as blade, air knife, rod, roll coating, etc. The choice of coating process would be determined from the economics of the operation and in turn, would determine the formulation specifications such as coating solids, coating viscosity, and coating speed.

The image-receiving layer thickness may range from about 1 to about 60 $\mu$m, preferably from about 5 to about 40 $\mu$m.

After coating, the ink jet recording element may be subject to calendering or supercalendering to enhance surface smoothness. In a preferred embodiment of the invention, the ink jet recording element is subject to hot, soft-nip calendering at a temperature of about 65° C. and a pressure of 14000 kg/m at a speed of from about 0.15 m/s to about 0.3 m/s.

Ink jet inks used to image the recording elements employed in the process of the present invention are well-known in the art. The ink compositions used in ink jet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference.

The following examples further illustrate the invention.

EXAMPLES

Example 1-Synthesis of Polystyrene Core/Poly(n-butylacrylate) Shell Latex(50:50)(Polymer 1)

The hard core-soft shell latex employed in this invention was prepared by a sequential emulsion polymerization technique. In general, the hard core polymer latex is polymerized first followed by the sequential feeding of the second low Tg monomer emulsions. A typical synthetic procedure of the hard core-soft shell latex of this invention is described below. The following ingredients were used:

TABLE 1

| | Ingredient (g) |
|---|---|
| A | Deionized Water (200) |
| | CTAB* (2) |
| B | 2,2'-Azobis(2-methylpropionamidine) HCL salt (0.5) |
| C | Styrene (200) |
| | 2,2'-Azobis(2-methylpropionamidine) HCL salt (2) |
| | CTAB (20) |
| | Deionized Water (200) |
| D | Butyl Acrylate (200) |
| | 2,2'-Azobis(2-methylpropionamidine) HCL salt (2) |
| | CTAB (20) |
| | Deionized Water (200) |

CTAB* is Cetyltrimethylammonium Bromide.

Procedure:

1. (A) was charged to a 2L 3-neck flask equipped with a nitrogen inlet, mechanical stirrer and condenser. The flask was immersed in a constant temperature bath at 80° C. and purged with nitrogen for 20 min.
2. (B) was added and followed by the addition of monomer emulsion (C). The mixture was agitated all the time during the feeding of monomer emulsion. The monomer emulsion was withdrawn from the bottom of the monomer reservoir with a Fluid Metering Pump. The addition time of monomer emulsion (C) was one hour and twenty minutes.
3. The polymerization was continued for 30 min after the addition of the first monomer.
4. The second monomer emulsion (D) was prepared in the same way. The total addition time was one hour and twenty minutes.
5. The latex was heated at 80° C. for one hour and cooled to 60° C.
6. 4ml of 10% t-butyl hydroperoxide and 10% formaldehyde-sulfite were added to remove the residual monomer and held for 30 minutes.
7. The mixture was cooled to RT and filtered.
8. The final % solid was 40.7% and the particle size was 81.2 nm.

Example 2

Element 1 of the Invention

A paper base of Nekoosa Solutions Smooth® (Georgia Pacific Co.), Grade 5128 (Carrara White®, Color 9220), basis weight 150 g/m$^2$, was coated with an suspension comprising 70 wt. % colloidal silica (Naycol® IJ 222, Akzo Nobel Co.) and 30 wt. % Polymer 1 described above. The coating solution was 20 wt. % total solids. The coating was applied onto the paper base using a wire wound Meyer rod of wire diameter 0.51 $\mu$m with a wet laydown thickness of 10 $\mu$m. The element was oven dried at 60° C.

Element 2 of the Invention

This element was prepared the same as Element 1 except that only 20 wt. % of Polymer 1 was used along with 10 wt. % of a polyurethane latex (Witcobond® W-213, Witco Corp.)

Element 3 of the Invention

This element was prepared the same as Element 1 except that the colloidal silica was replaced with colloidal boehmite (Dispal® 14N4-25, Condea Vista Co.).

Element 4 of the Invention

This element was prepared the same as Element 2 except that the colloidal silica was replaced with colloidal boehmite (Dispal® 14N4-25, Condea Vista Co.).

Element 5 of the Invention

A synthetic polymeric paper base (Teslin®, 250 $\mu$m, PPG Industry) was coated with an suspension comprising 80 wt. % colloidal silica (Naycol® IJ 222 Akzo Nobel Co.) and 20 wt. % Polymer 1. The coating solution was 20 wt. % total solids. The coating was applied onto the polymeric paper base using a wire wound Meyer rod of wire diameter 0.51 $\mu$m with a wet laydown thickness of 10 $\mu$m. The element was air dried at ambient conditions.

Element 6 of the Invention

This element was prepared the same as Element 5 except that only 15 wt. % of Polymer 1 was used along with 5 wt. % of a polyacrylic latex (Rhoplex® P-308, Rohm and Haas Co.).

Element 7 of the Invention

This element was prepared the same as Element 5 except that Polymer 2 was used instead of Polymer 1.

Element 8 of the Invention

This element was prepared the same as Element 5 except that Polymer 3 was used instead of Polymer 1.

Comparative Element 1

This element was prepared the same as Element 1 except that a polyurethane latex (Witcobond® W-213, Witco Corp.) was used instead of Polymer 1.

Comparative Element 2

This element was prepared the same as Element 1 except that a non-core/shell polymer, poly(styrene-co-butyl acrylate) was used instead of Polymer 1

Comparative Element 3

This element was prepared the same as Comparative Element 1 except that the colloidal silica was replaced with colloidal boehmite (Dispal ® 14N4-25, Condea Vista Co.).

Comparative Element 4

This element was prepared the same as Comparative Element 3 except that a non-core/shell polymer, poly (styrene-co-butyl acrylate) was used instead of the polyurethane latex.

Comparative Element 5

This element was prepared the same as Element 5 of the invention except that the Naycol® IJ 222 colloidal silica was replaced with Naycol® IJ 100 colloidal silica (Akzo Nobel Co.) and Polymer 1 was replaced with 20 wt. % of a polyacrylic latex (Rhoplex® P-308, Rohm and Haas Corp.).

Comparative Element 6

This element was prepared the same as Comparative Element 5 except that a non-core/shell polymer, poly (styrene-co-butyl acrylate) was used instead of a polyacrylic latex.

Printing

Images were printed using either an Epson Stylus Color 740 printer for dye-based inks using Color Ink Cartridge S020191/IC3CL01; or an Novajet III® wide-format inkjet printer for pigment-based inks using Kodak Professional Pigmented Inks: Black, Magenta, Cyan and Yellow. The images comprised a series of cyan, magenta, yellow, black, green, red and blue strips, each strip being in the form of a rectangle 0.8 cm in width and 20 cm in length.

Dry Time

Immediately after ejection from the printer, a piece of bond paper is placed over the printed image and rolled with a smooth, heavy weight. Then the bond paper is separated from the printed image. The length of dye transfer on the bond paper can be measured to estimate the time needed for the printed image to dry. The dry time is rated as 1 when there is no transfer of the inks to the bond paper. If there is a full transfer of at least one color strip, the dry time is rated as 5. Intermediate transfer lengths are rated in between 1 and 5.

Image Quality

The image quality is evaluated subjectively. Coalescence refers to the non-uniformity or puddling of the ink in solid filled areas. Bleeding refers to the inks flowing out of its intended boundaries.

The following results were obtained:

TABLE 2

| Epson 740 Printer | | |
|---|---|---|
| Element | Dry Time | Image Quality |
| 1 | 1 | good |
| 2 | 2 | good |
| 3 | 2 | good |
| 4 | 2 | good |
| Comparative 1 | 3 | slight coalescence |
| Comparative 2 | 5 | Slight coalescence, slight bleeding |
| Comparative 3 | 5 | Severe coalescence and bleeding |
| Comparative 4 | 5 | Severe coalescence and bleeding |

TABLE 3

| Novajet III Printer | | |
|---|---|---|
| Element | Dry Time | Image Quality |
| 5 | 1 | good |
| 6 | 1 | good |
| 7 | 1 | good |
| 8 | 1 | good |
| Comparative 5 | 2 | severe coalescence |
| Comparative 6 | 2 | severe coalescence |

The above results show that the elements employed in the process of the invention had good dry time and image quality as compared to the control elements which had poorer dry times and poorer image quality.

This invention has been described with particular reference to preferred embodiments thereof but it will be understood that modifications can be made within the spirit and scope of the invention.

What is claimed is:

1. An ink jet printing method, comprising the steps of:

A) providing an ink jet printer that is responsive to digital data signals;

B) loading said printer with ink-receptive elements comprising a substrate having thereon an image-receiving layer comprising an inorganic filler and coated particles comprising a polymeric hard core-polymeric soft shell latex, the Tg of said polymeric hard core material being greater than about 60° C., the Tg of said polymeric soft shell material being less than about 20° C., and said inorganic filler being present in said image-receiving layer in an amount of from about 50 to about 95% by weight;

C) loading said printer with an ink jet ink composition; and

D) printing on said ink-receptive element using said ink jet ink in response to said digital data signals.

2. The method of claim 1 wherein said inorganic filler comprises a metal oxide or metal hydroxide.

3. The method of claim 2 wherein said metal oxide is silica, alumina, zirconia or titania.

4. The method of claim 1 wherein the particle size of said filler is from about 5 nm to about 1000 nm.

5. The method of claim 1 wherein said polymeric hard core material is poly(methylmethacrylate), poly(styrene), poly(p-methylstyrene), poly(t-butylacrylamide) or poly (styrene-co-methylmethacrylate).

6. The method of claim 1 wherein said polymeric soft shell material is poly(n-butyl acrylate), poly(2-ethylhexyl acrylate) poly(methoxyethylacrylate), poly(ethoxyethylacrylate), poly(n-butylacrylate-co-trimethylammoniumethyl acrylate), poly(n-butylacrylate-co-trimethylammoniumethyl methacrylate) or poly(n-butylacrylate-co-vinylbenzyltrimethylammonium chloride).

* * * * *